US005198017A

United States Patent [19]

Mourer et al.

[11] Patent Number: 5,198,017

[45] Date of Patent: Mar. 30, 1993

[54] APPARATUS AND PROCESS FOR CONTROLLING THE FLOW OF A METAL STREAM

[75] Inventors: David P. Mourer, Danvers; Roy W. Christensen, North Borough, both of Mass.

[73] Assignee: General Electric Company, Cincinnati, Ohio

[21] Appl. No.: 833,866

[22] Filed: Feb. 11, 1992

[51] Int. Cl.[5] ..... B22D 41/60

[52] U.S. Cl. ..... 75/345; 266/78; 222/592

[58] Field of Search ..... 222/591, 592, 593, 606, 222/607; 75/345; 266/99, 78, 87

[56] References Cited

U.S. PATENT DOCUMENTS

| | | | |
|---|---|---|---|
| 2,618,013 | 11/1952 | Weigand et al. | 18/2.5 |
| 3,099,041 | 7/1963 | Kaufmann | 18/2.6 |
| 3,342,250 | 9/1967 | Treppschuh et al. | 164/50 |
| 3,826,598 | 7/1974 | Kaufmann | 425/7.65 |
| 4,067,674 | 1/1978 | Devillard | 425/8 |
| 4,218,410 | 8/1980 | Stephan et al. | 264/8 |
| 4,966,201 | 10/1990 | Svec et al. | 138/141 |

FOREIGN PATENT DOCUMENTS

| | | |
|---|---|---|
| 54-442 | 1/1979 | Japan . |
| 57-75128 | 5/1982 | Japan . |
| 1296288 | 11/1972 | United Kingdom . |
| 1514379 | 6/1978 | United Kingdom . |
| 1529858 | 10/1978 | United Kingdom . |
| 2117417A | 10/1983 | United Kingdom . |
| 2142046B | 1/1987 | United Kingdom . |

*Primary Examiner*—Scott Kastler

*Attorney, Agent, or Firm*—Carmen Santa Maria; Jerome C. Squillaro

[57] ABSTRACT

An apparatus that controls the flow of a stream of metal, such as produced from the bottom of a hearth, includes a cylindrical metallic nozzle body having a hollow wall which includes a slit extending substantially parallel to the axis of the cylinder so that there is no electrical continuity around the nozzle wall across the slit. The walls of the cylinder are preferably formed of hollow tubes through which cooling water is passed. A sensor senses a performance characteristic of the apparatus, such as the temperature of the nozzle body. An induction heating coil surrounds the nozzle body, and a controllable induction heating power supply is connected to the induction heating coil to provide power. A controller controls the power provided to the induction heating coil by the induction heating power supply responsive to an output signal of the sensor, so that a selected performance characteristic of the apparatus may be maintained.

22 Claims, 2 Drawing Sheets

APPARATUS AND PROCESS FOR CONTROLLING THE FLOW OF A METAL STREAM

BACKGROUND OF THE INVENTION

This invention relates to metallurgical technology, and, more particularly, to controlling the flow of a stream of molten metal.

Metallic articles can be fabricated in any of several ways, one of which is metal powder processing. In this approach, fine powder particles of the metallic alloy of interest are first formed. Then the proper quantity of the particulate or powdered metal is placed into a mold or container and compacted by hot or cold isostatic pressing, extrusion, or other means. This powder metallurgical approach has the important advantage that the microstructure of the product produced by powder consolidation is typically finer and more uniform than that produced by conventional techniques. In some instances the final product can be produced to virtually its final shape, so that little or no final machining is required. Final machining is expensive and wasteful of the alloying materials, and therefore the powder approach to article fabrication is often less expensive than conventional techniques.

The prerequisite to the use of powder fabrication technology is the ability to produce a "clean" powder of the required alloy composition on a commercial scale. (The term "clean" refers to a low level of particles of foreign matter in the metal.) Numerous techniques have been devised for powder production. In one common approach, a melt of the alloy of interest is formed, and a continuous stream of the alloy is produced from the melt. The stream is atomized by a gas jet or a spinning disk, producing solidified particles that are collected and graded for size. Particles that meet the size specifications are retained, and those that do not are remelted. The present invention finds application in the formation and control of the stream of metal that is drawn from the melt and directed to the atomization stage. More generally, it finds application in the formation and control of metal streams for use in other clean-metal production techniques.

The alloys of titanium are of particular interest in powder processing of aerospace components. These alloys are strong at low and intermediate temperatures, and much lighter than cobalt and nickel alloys that are used for higher temperature applications. However, molten titanium alloys are highly reactive with other materials, and can therefore be easily contaminated as they are melted and directed as a stream toward the atomization stage unless particular care is taken to avoid contamination.

Several approaches have been devised for the melting and formation of a stream of a reactive alloy such as a titanium alloy. In one such approach, the alloy is melted in a cold hearth by induction heating. The alloy stream is extracted through the bottom of the hearth and directed toward the atomization apparatus. The stream may be directed simply by allowing it to free fall under the influence of gravity. To prevent excessive cooling of the stream as it falls, electrical resistance heating coils have been placed around a ceramic nozzle liner through which the stream passes, as described for example in U.S. Pat. No. 3,604,598. Another approach is to place an induction coil around the volume through which the stream falls, both to heat the stream and to control its diameter, as described for example in U.S. Pat. No. 4,762,553. These and similar techniques have not proved commercially acceptable for the control of a stream of a reactive titanium alloy for a variety of reasons.

There therefore exists a need for an improved approach to the formation and control of a stream of a metal, and particularly for reactive metals such as titanium alloys. The present invention fulfills this need, and further provides related advantages.

SUMMARY OF THE INVENTION

The present invention provides an apparatus for controlling the flow of a metal stream, without contaminating the metal by contact with foreign substances. The apparatus permits precise control of the metal stream based upon a variety of control parameters.

In accordance with the invention, apparatus for controlling the flow of a metal stream comprises a hollow frustoconical metallic nozzle body having a hollow wall, the hollow wall having an inner surface and an outer surface extending from a first base to a second base for a height h, the height h being the perpendicular distance between the first base and the second base, the frustoconical nozzle body further having at least one slit extending from the first base to the second base so that the wall lacks electrical continuity across the slit, and means for cooling the nozzle body. An induction heating coil surrounds the nozzle body, and a controllable induction heating power supply is connected to the induction heating coil. A sensor senses a performance characteristic of the apparatus. A controller controls the power provided to the induction heating coil by the induction heating power supply responsive to an output signal of the sensor, to maintain a selected performance characteristic of the apparatus.

The flow of metal is typically controlled to maintain the nozzle temperature within a preselected range, and also to maintain a preselected metal stream diameter or flow rate. The metal stream diameter is selected to be less than an inside dimension of the nozzle body, so that there is a solidified layer of the metal, termed a "skull" in the art, between the flowing metal of the stream and the inner surface of the nozzle body. The skull prevents contact between the flowing metal and the wall inner surface of the nozzle body, ensuring that the material of the wall cannot dissolve into the metal stream and contaminate it. Decreasing the power to the induction coil or operating at a lower frequency will cause the skull to thicken, ultimately becoming so thick that the flow of metal is stopped altogether. Thus, the apparatus can act as a valve for the metal stream.

The required degree of control cannot be achieved in the absence of a cooled nozzle body and induction heating of the skull and stream. This system establishes a delicate heat balance which can be readily controlled to produce the desired results. The cooled nozzle body extracts heat from the portion of the skull closest to it. Simultaneously, electromagnetic currents induced within the skull by the induction coil limit the amount of heat extracted from the flowing metal stream. Although much of the heat generated by induced current flows radially outward toward the nozzle wall for extraction, sufficient heat is applied to achieve the desired skull thickness and stream diameter. Increasing induction power increases the total heat input into the system and melts away a portion of the skull inner surface, resulting in an increase in stream diameter. Decreasing the induction power reduces the heat input and will increase the skull inner surface, if desired to the point of freeze off. The feedback control system is useful in maintaining preselected values throughout the course of extended operation to maintain the required heat balances and achieve the desired results. The use of electrical resistance heating in place of induction heating is unacceptable, because the heat input rate is too low and because the thickness of the skull layer cannot be adequately controlled. Unlike induction heating, resistance heating cannot be controlled to selectively act to heat the metal skull or stream without undesirably and uncontrollably affecting the nozzle body.

Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENTS

A preferred application of the apparatus for controlling the flow of a metal stream is in a metal powder production facility. The apparatus for controlling the flow of a metal stream may be used in other applications, such as, for example, a metal ingot production facility. The metal powder production facility is the presently preferred application, and is described so that the structure and operation of the present invention can be fully understood.

Figure 1:
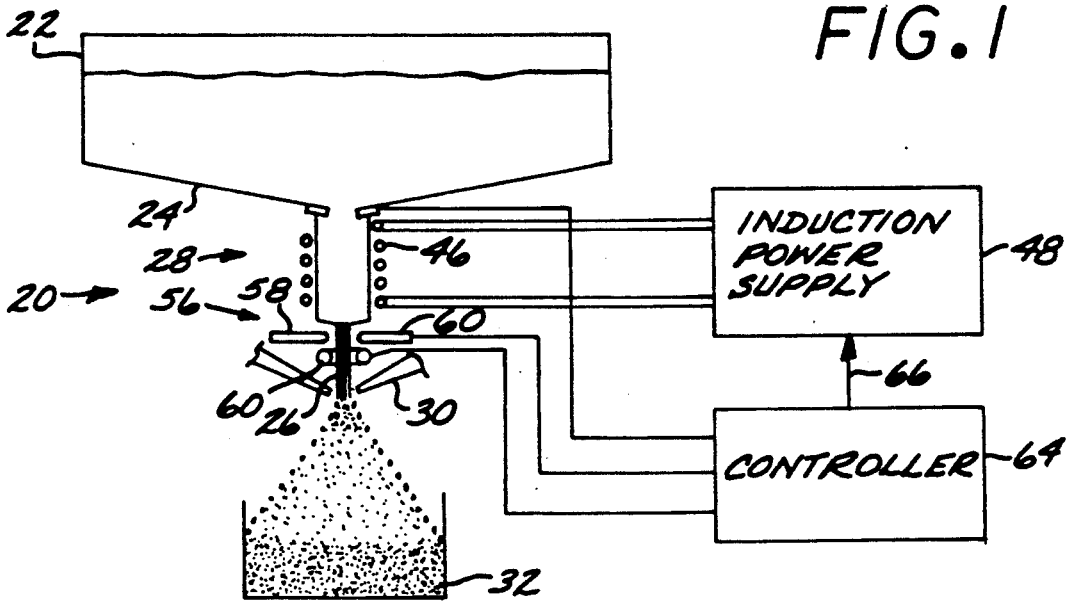
FIG. 1 is a schematic drawing of a metal powder production facility using the apparatus of the invention for controlling the flow of a metal stream.

Referring to FIG. 1, a powder production facility 20 includes a crucible 22 in which metal is melted on a hearth 24. The molten metal flows as a stream 26 through an opening in the hearth 24. After leaving the hearth, the stream 26 passes through a nozzle region 28 where control of the stream is achieved, and which will be discussed in detail subsequently. The stream 26 is atomized into fine liquid metal particles by impingement of a gas flow from a gas jet 30 onto the stream 26. The atomization gas is typically argon or helium in the case where the metal being atomized is a titanium alloy. The particles quickly solidify, and fall into a bin 32 for collection. (Equivalently, the particles can be formed by directing the stream 26 against a spinning disk.)

In accordance with the invention, apparatus for controlling the flow of a metal stream from a water-cooled hearth comprises a frustoconical nozzle body made of a conductive metal, such as copper, having a hollow wall, the hollow wall having an inner surface and an outer surface extending from a first base to a second base for a height h, the height h being the perpendicular distance between the first base and the second base, the frustoconical nozzle body further having at least one slit extending from the first base to the second base so that there is no electrical continuity in the nozzle wall, means for cooling the nozzle body, and further including a temperature sensor that senses the temperature of the nozzle body. The nozzle body, which may include provisions for circulating optional cooling fluid, has a flange at one end or base thereof suitable for attachment to the fluid-cooled hearth. This base may be electrically conductive and have electrical continuity. The preferred fluid is water although other fluids such as inert gases, and other liquid or gaseous media may be used. An induction heating coil surrounds the nozzle body, and a controllable induction heating power supply provides power to the induction heating coil. A controller controls the power provided to the induction heating coil by the induction heating power supply responsive to an output signal of a monitoring sensor, preferably a signal responsive to the temperature measured by the temperature sensor.

Figure 2:
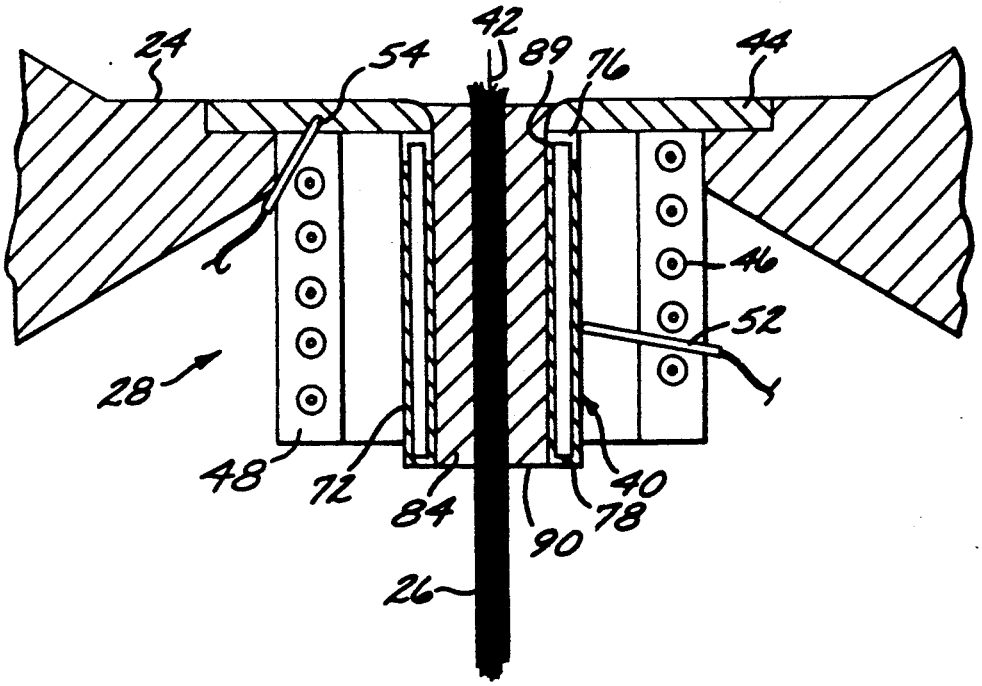
FIG. 2 is a side sectional view of the nozzle region of the apparatus of FIG. 1.
Figure 3:
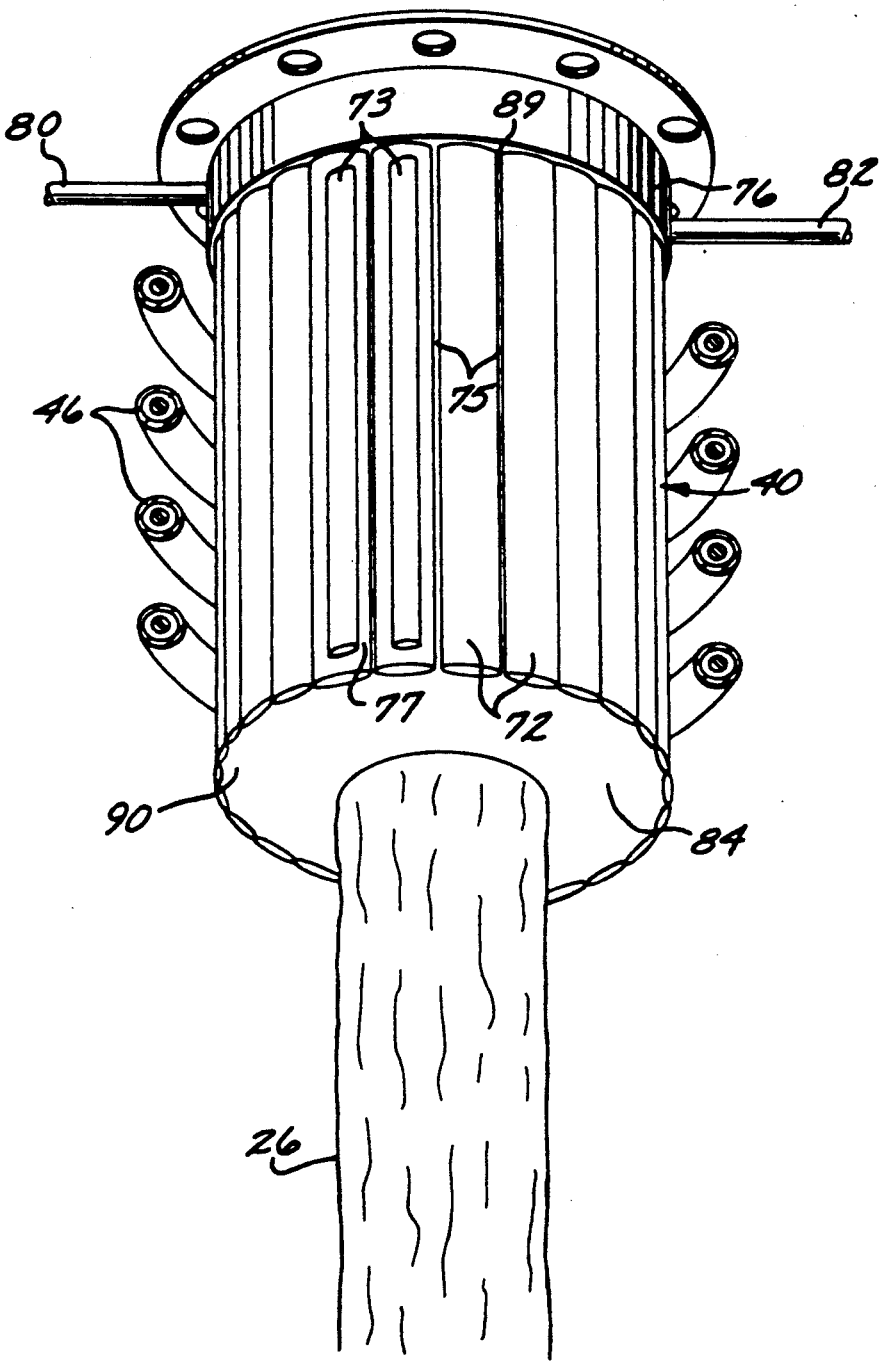
FIG. 3 is an enlarged perspective view of the preferred nozzle of FIG. 2.

Referring to FIGS. 2 and 3, a nozzle body 40 is formed of a plurality of hollow tubes 72 positioned around a circumference and extending from a first base 89 to a second base 90, each tube spaced from an adjacent tube sufficiently so that there is no electrical continuity among the tubes, and having the general shape of a right-angle frustocone, and preferably is in the form of a substantially right circular hollow cylinder wherein the size of the nozzle entrance and nozzle exit, located at the first end and the second end respectively, are substantially the same. In the general form of a frustocone, the nozzle body is tapered from a first end or base 89 to a second end or base 90 so that the geometry of the nozzle at the first base 89 or entrance, where metal enters is less restrictive than at the second end or base 90 where the metal exits. In this configuration, bottom pouring and tapping of the melt as well as steady state flow is facilitated by the tapered configuration. In the preferred embodiment, steady state flow and operation is achieved by balancing heat input and output within and through the nozzle solely by means of the controls system. The detailed construction of the walls of the nozzle body 40 will be discussed in greater detail in relation to FIG. 3.

The nozzle body 40 is elongated parallel to a cylindrical axis 42. At the upper end of the nozzle body 40 is a flange 44, which may be fluid-cooled and which may supply cooling fluid to the tubes which form the nozzle. This flange 44 permits the nozzle body 40 to be attached to the fluid-cooled hearth 24. It is understood that the same fluid cooling medium will be used in the nozzle and the hearth when they are integrally connected, providing for a more economical arrangement, although each may be served by independent cooling systems. The nozzle body 40 is usually made of a conductive metal such as copper, or a refractory metal selected from the group consisting of tungsten, tantalum and molybdenum.

An induction heating coil 46 is placed around the nozzle body 40, in the shape of the nozzle body exterior. In the general form, this shape is a right-angle frustocone, while in the preferred embodiment, this shape is substantially a cylinder. The induction heating coil 46 is typically a helically wound coil of hollow copper tubing through which cooling fluid, preferably water, is passed, and to whose ends a high frequency alternating current is applied by a controllable induction heating power supply 48. The alternating current is in the range of about 3–450 KHz, typically about 10–50 KHz, or higher depending upon the nozzle dimensions and the desired metal flow rate. Although induction heating coil 46 in FIG. 2 is depicted as having uniform coil spacing, it will be understood that coil spacing may be varied to better match heat input to local losses to aid in providing a more uniform and controllable skull thickness, particularly at the entrance and exit of the nozzle body 40.

In the view of FIG. 2, the induction heating coil 46 is encased within a protective ceramic housing 48, a technique known in the art. Alternatively, the induction heating coil may be suspended around the nozzle body 40 without any covering, as shown in the embodiment of FIG. 3.

A sensor to measure a performance characteristic of the apparatus is provided. The sensor may be a temperature sensor 52 such as a thermocouple contacting, or inserted into, the nozzle body 40 on its side wall or a temperature sensor 54 such as a thermocouple contacting, or inserted into, the flange 44 portion of the nozzle body 40. Alternatively, the performance may be monitored by a temperature sensor positioned in or proximate to the skull (not shown) to monitor the skull temperature. Some other sensors are depicted in FIG. 1. The sensor may be a diametral sensor 56 that measures the diameter of the metal stream 26. Such a diametral sensor 56 operates by passing a laser or light beam from a source 58 to a detector 60, positioned so that the object being measured is between the source 58 and the detector 60. The light beam is wider than the expected maximum diameter of the object, here the stream 26. The amount of light reaching the detector 60 depends upon the diameter of the stream 26, and gives a measure of the stream diameter. The diametral sensor can alternatively be a position sensor 62, such as a video position analyzer with a source described in U.S. Pat. Nos. 4,687,344 and 4,656,331 (whose disclosures are incorporated by reference), and a signal analyzer available commercially from Colorado Video as the Model 635. Alternatively, the weight change of the bin 32 as a function of time provides the mass flow of metal.

The output signal of each of the sensors 52, 54, 56, 60 and 62, or other type of sensor that may be used, is provided as the input to a controller 64. The controller 64 may be a simple bridge type of unit, or, more preferably, may be a programmed microcomputer into which various combinations of control commands and responses to particular situations can be programmed. The output of the controller 64 is a command signal to the induction heating power supply 48. The command signal 66 closes a feedback control loop to the induction heating coil 46, so that the heat input to the nozzle region 28 is responsive to the selected performance characteristic of the apparatus. For example, the controller 64 may be operated to maintain the diameter of the metal stream 26 within certain limits, and also not to permit the temperature measured by the temperature sensors 52 and 54 to become too high. The controller varies the command signal 66 to achieve this result, and may also be programmed to control other portions of the system such as the power to the crucible 22 or the water cooling flow to any portion of the system.

The structure of the nozzle is shown in perspective view in FIG. 3. The nozzle body 40 is formed from a plurality of hollow tubes 72 arranged around the circumferential surface of a cylinder, on a cylindrical locus, with the tubes 72 parallel to the cylindrical axis 42 which is perpendicular to the plane formed by the circumference of the cylinder. A tubular construction, with each tube representing a finger, is utilized so current induced in the nozzle 40 by induction coil 46 will flow around the individual tubes 72 and into the nozzle inner diameter. Each tube is sufficiently spaced from the other tubes so there is no electrical continuity among adjoining tubes, except in the general region of the manifold 76, positioned at the first base 89 or upper end of the nozzle. This construction forces induced currents in the fingers to travel around the outer diameter of the individual tubes creating a magnetic field inside the nozzle. This magnetic field in turn penetrates the skull 84 inducing a current flow at right angles to it in accordance with the right hand rule and generating heat within the skull 84. The depth of the penetration of this magnetic field is dependent on the frequency of the current flow and the conductivity of the skull material. In this way, the electromagnetic field generated from the current in the tubes "couples" to the skull 84 to provide a method for controlling the metal stream 26. If there is electrical continuity in the nozzle, as when there is no effective slit or when the tubes are sufficiently close together, the nozzle is ineffective.

To provide structural continuity, an insulating material such as a high-temperature cement can be placed into the slits or interstices 75 between the tubes 72 around the periphery of the nozzle body 40.

At the upper end or first base 89, the tubes 72 are fixed to a hollow cylindrical manifold 76, which in turn is fixed to the flange 44. Within each of the tubes 72 is a second set of smaller tubes 73, having a smaller diameter than tubes 72 such that an annulus 77 is formed between tubes 72 and smaller tubes 73, extending from the manifold 76 almost to the lower end or second base 90. The cooling fluid, which may be water or a cooling gas, is supplied through these smaller tubes 73 and returns in the annulus 77 between the two tubes 72, 73 making each pair of tubes 72, 73 an individual cooling circuit. The manifold 76 is supplied with external coolant connectors 80 and 82, respectively, so that a flow of cooling water can be passed through the tubes 72, 73. The flange 44 is provided with bolt holes or other attachment means to permit it to be attached to the underside of the hearth 24.

The present invention extends to the operation of the apparatus for controlling the metal stream. In accordance with this aspect of the invention, a process for controlling the flow of a stream of molten metal comprises the steps of providing an apparatus comprising a hollow frustoconical metallic nozzle body 40 having a hollow wall, the hollow wall having an inner surface and an outer surface extending from a first base 89 to a second base 90 for a height h, the height h being the perpendicular distance between the first base 89 and the second base 90, the frustoconical nozzle body 40 further having at least one slit extending from the first base 89 to the second base 90 so that there is no electrical continuity in the nozzle wall, means for cooling the nozzle body, an induction heating coil 46 surrounding the nozzle body 40, a sensor that senses a performance characteristic of the apparatus, a controllable induction heating power supply connected to the induction heating coil, and a controller that controls the power provided to the induction heating coil by the induction heating power supply responsive to an output signal of the sensor, to maintain a selected performance characteristic of the apparatus; and controlling the power provided to the induction heating coil 46 to maintain a preselected flow of metal in the stream.

The induction heating coil 46 is positioned on the exterior of the nozzle body and may assume the shape of the exterior of the nozzle body. The induction coil may have variable spacing of the coils to permit a preselected, tailored heating profile along the length of the nozzle. For example, the coil may have a concentration of turns at the second base or lower end of the nozzle to provide more heat input at this location to facilitate melting off of adhering metal at this location. A multi-turned coil is preferred.

Thus, an apparatus such as those described previously is used to attain and maintain a preselected set of conditions. In one typical operating condition, the alternating current frequency and power applied by the power supply 48 to the induction heating coil 46 are selected to maintain a solid metal skull 84 between the outer periphery of the metal stream 26 and the inner wall of the nozzle body 40. That is, radially outward heat loss from the stream 26 into the nozzle body 40 is sufficiently fast to freeze the outer periphery of the metal stream 26 to the inner wall of the nozzle body 40. The unfrozen, flowing metal stream 26 within the nozzle body 40 contacts only the frozen metal comprising the skull 84 having its own composition, and does not contact any foreign substance used in the construction of the wall of the nozzle body. There is no chance of contamination of the moving flow of metal by contact with walls of another material This feature is highly significant for the control of metal streams of reactive metals such as titanium alloys, which readily absorb contaminants. Although control of the frequency and the power provides maximum flexibility in the system, the same results can be accomplished by varying only the power.

The skull 84 can be made thicker or thinner by selectively controlling the power supply 48 and the cooling of the nozzle body 40, with commands from the controller 64. Cooling may be accomplished by any one of a variety of means, such as by flowing a cooling fluid through the hollow nozzle body or through the tubes comprising the nozzle body, or by flowing a stream of cooling gas across the exterior of the nozzle body. If the skull 84 is made thicker, the diameter of the flowing portion of the metal stream 26 becomes smaller. If the skull 84 is made thinner, the diameter of the metal stream 26 becomes larger. The control of skull thickness is used as a valve to decrease or increase the size of the flowing stream 26 and thence the volume flow rate of metal By increasing the thickness of the skull 84 indefinitely, the flow of metal can be shut off entirely by the solid skull that reaches across the full width of the nozzle body 40 The flow can be restarted by reversing the process and decreasing the thickness of the skull. Since this degree of control may require delicate manipulations, it is preferred that the controller 64 be a programmed minicomputer.

Using the approach of the invention, full metal stream flow control is achieved reproducibly and neatly without contamination of the metal of the metal stream. Although the present invention has been described in connection with specific examples and embodiments, it will be understood by those skilled in the arts involved, that the present invention is capable of modification without departing from its spirit and scope as represented by the appended claims.

What is claimed is:

1. Apparatus for controlling the flow of a metal stream, comprising:

a frustoconical metallic nozzle body having a hollow wall, the hollow wall having an inner surface and an outer surface and extending from a first base to a second base, the body further having at least one slit extending from the first base to the second base so that the wall lacks electrical continuity across the slit;

means for cooling the nozzle body to form a metal skull on the inner surface of the nozzle body hollow wall;

an induction heating coil surrounding the nozzle body;

a sensor that measures at least one performance characteristic of the apparatus selected from the group of performance characteristics including a diameter of the metal stream, a volume flow rate of the metal stream, a temperature of the nozzle body, a temperature of the metal skull;

a controllable induction heating power supply connected to the induction heating coil; and a controller that controls the power provided to the induction heating coil by the induction heating power supply responsive to an output signal of the sensor, to maintain the selected performance characteristic of the apparatus.

2. The apparatus of claim 1, wherein the nozzle body is formed of a refractory metal selected from the group consisting of tungsten, tantalum and molybdenum.

3. The apparatus of claim 1, wherein the nozzle body is formed of a plurality of first hollow tubes positioned around a circumference and extending from the first base to the second base, each tube spaced from an adjacent tube sufficiently so that there is no electrical continuity between adjacent tubes.

4. The apparatus of claim 3 further including a second hollow tube within each of the plurality of first hollow tubes, each of the second hollow tubes having a diameter smaller than the diameter of the plurality of first hollow tubes so that cooling water supplied from a manifold positioned at the first base to each of the second hollow tubes flows through each of the second hollow tubes and returns to the manifold between an annulus between the plurality of first hollow tubes and each of the second tubes.

5. The apparatus of claim 1, wherein means for cooling includes a cooled heat sink attached to the nozzle body.

6. The apparatus of claim 1, wherein means for cooling includes cooling channels within the nozzle body through which cooling fluid flows.

7. The apparatus of claim 1 wherein means for cooling includes a cooling fluid flowing through the hollow nozzle body.

8. The apparatus of claim 1 wherein means for cooling includes a high velocity gas flowing around the nozzle exterior

9. The apparatus of claim 1, wherein the selected performance characteristic is the temperature of the nozzle body measured by a temperature sensor.

10. The apparatus of claim 9, wherein the temperature sensor is a thermocouple in contact with the nozzle body.

11. Apparatus for controlling the flow of a metal stream flowing from a water-cooled hearth, comprising:

a frustoconical metallic nozzle body having a hollow wall, the hollow wall having an inner surface and an outer surface and extending from a first base to a second base, the body further having at least one slit extending from the first base to the second base so that the wall lacks electrical continuity across the slit, the nozzle body further having a flange at a first base thereof suitable for attachment to the water-cooled hearth;

an induction heating coil surrounding the nozzle body exterior;

a temperature sensor that senses the temperature of the nozzle body;

a controllable induction heating power supply connected to the induction heating coil; and a controller that controls the power provided to the induction heating coil by the induction heating power supply responsive to the temperature measured by the temperature sensor.

12. The apparatus of claim 11, wherein the nozzle body is formed of a refractory metal selected from the group consisting of tungsten, tantalum and molybdenum.

13. The apparatus of claim 11, wherein the nozzle body is formed of a plurality of hollow tubes positioned around a circumference and extending from the first base to the second base.

14. Apparatus for controlling the flow of a metal stream, comprising a hollow cylindrical nozzle body formed of a plurality of conductive hollow tubes disposed along a substantially cylindrical locus and extending parallel to an axis perpendicular to the plane of the cylindrical locus thereby forming a cylinder, the nozzle body having a flange at one end thereof suitable for attachment to a water-cooled hearth.

15. The apparatus of claim 14, further comprising:

means for heating the nozzle body, the means for heating being external to the nozzle body.

16. The apparatus of claim 14, further including an induction heating coil surrounding the nozzle body exterior;

a sensor that senses a performance characteristic of the apparatus;

a controllable induction heating power supply connected to the induction heating coil; and a controller that controls the power provided to the induction heating coil by the induction heating power supply responsive to the temperature measured by the temperature sensor.

17. A process for controlling the flow of a stream of molten metal, comprising the steps of:

providing an apparatus comprising a substantially frustoconical metallic nozzle body having a hollow wall, the hollow wall having an inner surface and an outer surface and extending from a first base to a second base, the body further having at least one slit extending from the first base to the second base so that the wall lacks electrical continuity across the slit.

means for cooling the nozzle body to form a metal skull on the inner surface of the nozzle body hollow wall, an induction heating coil surrounding the nozzle body, a sensor that measures at least one performance characteristic of the apparatus selected from the group of performance characteristics including a diameter of the metal stream, a volume flow rate of the metal stream, a temperature of the nozzle body, a temperature of the metal skull, a controllable induction heating power supply connected to the induction heating coil, and a controller that controls the power provided to the induction heating coil by the induction heating power supply responsive to an output signal of the sensor, to maintain a selected performance characteristic of the apparatus; and controlling the power provided to the induction heating coil to maintain a preselected flow of metal in the stream.

18. The process of claim 17, wherein the selected performance characteristic is the temperature of the nozzle body measured by a temperature sensor, and the preselected flow of metal in the stream is an amount of metal sufficient to maintain a preselected temperature as measured by the sensor.

19. The process of claim 17, wherein the selected performance characteristic is the diameter of the metal stream measured by a stream diameter sensor, and the preselected flow of metal in the stream is an amount of metal sufficient to have a preselected stream diameter.

20. The process of claim 17, wherein the selected performance characteristic is the stream volume flow rate of the metal stream measured by a stream volume flow rate sensor, and the preselected flow of metal in the stream is an amount of metal sufficient to have a preselected stream volume flow rate.

21. The apparatus of claim 1, wherein the nozzle body is formed of copper.

22. The apparatus of claim 11, wherein the nozzle body is formed of copper.

* * * * *